US008453463B2

(12) United States Patent
Grewal et al.

(10) Patent No.: US 8,453,463 B2
(45) Date of Patent: Jun. 4, 2013

(54) ANTI-VORTEX DEVICE FOR A GAS TURBINE ENGINE COMPRESSOR

(75) Inventors: Daljit Singh Grewal, Brampton (CA); Alessandro Ciampa, Montreal (CA); Jean-Francois Caron, Drummondville (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 984 days.

(21) Appl. No.: 12/472,720

(22) Filed: May 27, 2009

(65) Prior Publication Data

US 2010/0300113 A1 Dec. 2, 2010

(51) Int. Cl.
*F02C 7/18* (2006.01)

(52) U.S. Cl.
USPC ..... 60/782; 60/785; 60/806; 60/269; 415/115; 415/144; 415/175

(58) Field of Classification Search
USPC . 60/782, 785, 39.08, 806, 726, 269; 415/115, 415/175, 144; 416/198 R, 203, 175
See application file for complete search history.

(56) References Cited

U.S. PATENT DOCUMENTS

| | | | | |
|---|---|---|---|---|
| 2,618,433 | A | 11/1952 | Loos et al. | |
| 3,897,168 | A | 7/1975 | Amos | |
| 4,236,869 | A | 12/1980 | Laurello | |
| 4,541,774 | A | 9/1985 | Rieck et al. | |
| 5,581,996 | A | 12/1996 | Koch et al. | |
| 5,997,244 | A * | 12/1999 | Gebre-Giorgis et al. | 415/115 |
| 6,488,469 | B1 | 12/2002 | Youssef et al. | |
| 6,647,730 | B2 | 11/2003 | Liu | |
| 6,966,191 | B2 | 11/2005 | Fukutani et al. | |
| 7,159,402 | B2 * | 1/2007 | Hein et al. | 60/785 |
| 7,624,580 | B2 * | 12/2009 | Fukutani | 60/785 |
| 7,708,519 | B2 | 5/2010 | Mignano | |

* cited by examiner

*Primary Examiner* — Ehud Gartenberg
*Assistant Examiner* — Steven Sutherland
(74) *Attorney, Agent, or Firm* — Norton Rose Canada LLP

(57) ABSTRACT

An anti-vortex device for use in a compressor rotor assembly of a gas turbine engine is described. Spaced-apart radial passageways extend from an axially extending passage provided in a central area of the device to an outer peripheral rim surface thereof. The radial passageways channel air from the primary gaspath about the rotor assembly to the axially extending passage where the air is directed into a central axial passage of the rotor assembly.

17 Claims, 4 Drawing Sheets

ANTI-VORTEX DEVICE FOR A GAS TURBINE ENGINE COMPRESSOR

TECHNICAL FIELD

The present application relates to gas turbine engines and, more particularly, to an anti-vortex structure for a compressor.

BACKGROUND OF THE ART

Conventional compressor bleed arrangements typically consist of a relatively complex assembly of parts, such as discs, plates, sheet metal guide vanes, conical members, shafts and rotors. All these parts are cumbersome and add to the overall weight and cost of the engine. Space limitations as well as the needs for not disrupting the airflow in the main gas path of the engine also render the installation of multi-parts bleeding arrangement challenging. Multi-part assemblies also suffer from non-negligible pressure drops notably at the joints between differently oriented parts. They may also affect the balance of the compressor rotor when mounted thereto.

SUMMARY

Therefore, in accordance with one aspect of the present application, there is provided a compressor rotor assembly mounted for rotation about a central axis of a gas turbine engine, comprising an anti-vortex device having a peripheral rim surface defining an inner boundary of a primary gas path of the engine, the anti-vortex device defining circumferentially spaced-apart radial passageways extending from respective axially extending central passages to an outer peripheral rim surface of the device, each said radial passageway receiving bleed air from the primary gas path and directing it to an associated one of said axially extending passages.

Another general aspect of the present application is to provide a gas turbine engine comprising a compressor having at least two rotors mounted for joint rotation about a central axis, a combustor and a turbine section; the compressor has an anti-vortex device secured between said at least two rotors, the anti-vortex device having a solid body portion, circumferentially spaced-apart radial passageways defined in said solid body portion, each said radial passageway extending from an axial passage extending through the solid body portion in a central area thereof to an outer peripheral rim surface of the solid body portion, the outer peripheral rim surface being spaced inwardly of an air bleed gap formed between said at least two rotors and in communication with a gas path of the engine, the anti-vortex device channeling air from the gas path in non-interference therewith through said air bleed gap and into said radial passageways and said axial passage, said axial passage redirecting said air under pressure in two opposite axial directions.

In accordance with a further general aspect, there is provided a method of reducing total pressure drop and the formation of free vortex in a flow of compressed air bled inwardly from a compressor of a gas turbine engine, the method comprising: providing circumferentially spaced-apart radial passageways extending from an axial passage extending through the compressor in a central area thereof to an outer peripheral rim of a compressor hub; bleeding compressed air from a gas path of the compressor through said radial passageways and directing said compressed air to said axial passage when said compressor rotor assembly is rotating; and directing at least some of the compressed air bled from said axial passage, via a central axially-extending passage of the compressor rotor assembly, to a turbine section of said gas turbine engine to cool turbine components in said turbine section.

DESCRIPTION OF THE DRAWINGS

Reference is now made to the accompanying figures, in which.

DETAILED DESCRIPTION

Figure 1:
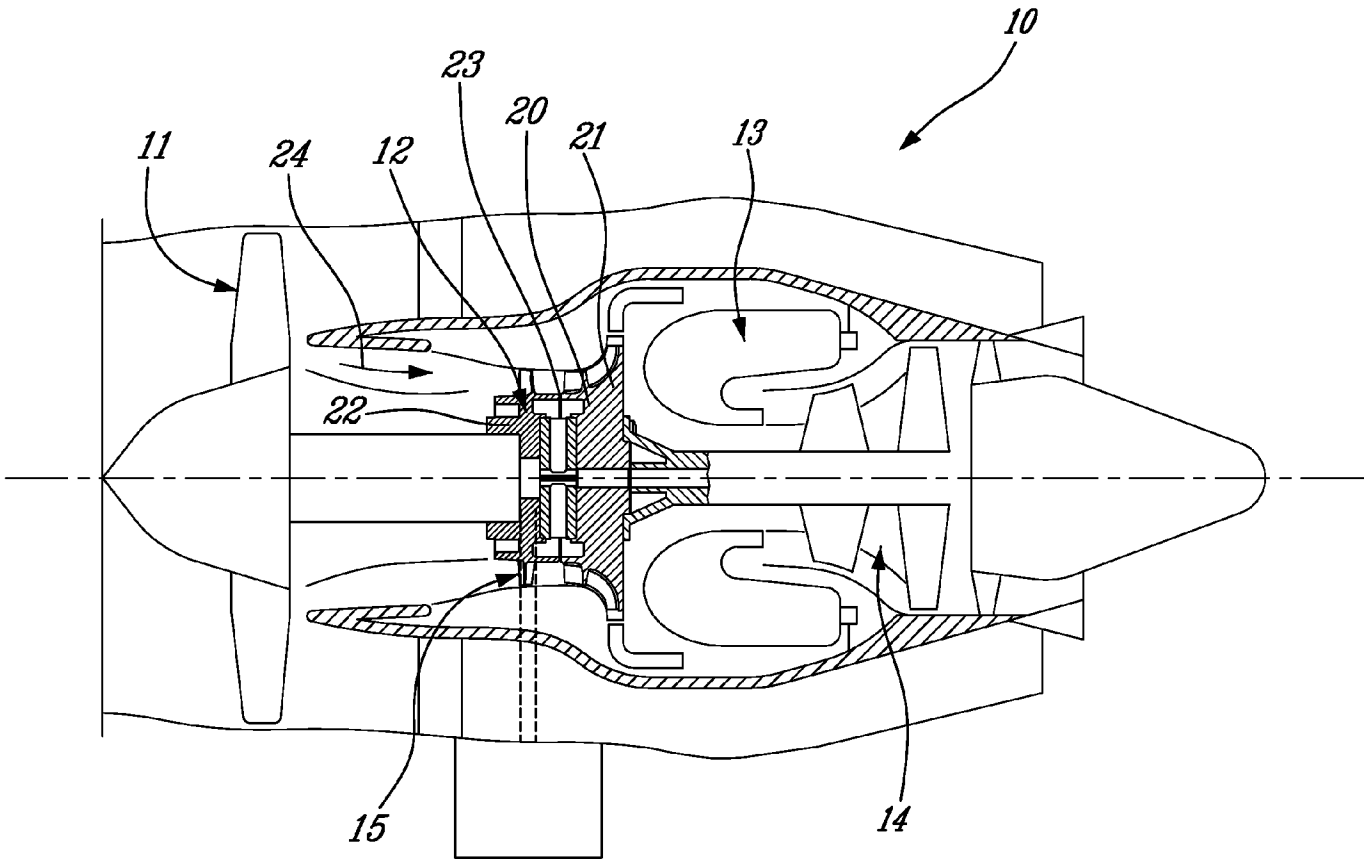
FIG. 1 is a schematic cross-sectional view of a gas turbine engine showing an example of an anti-vortex device according to the present description.
Figure 2:
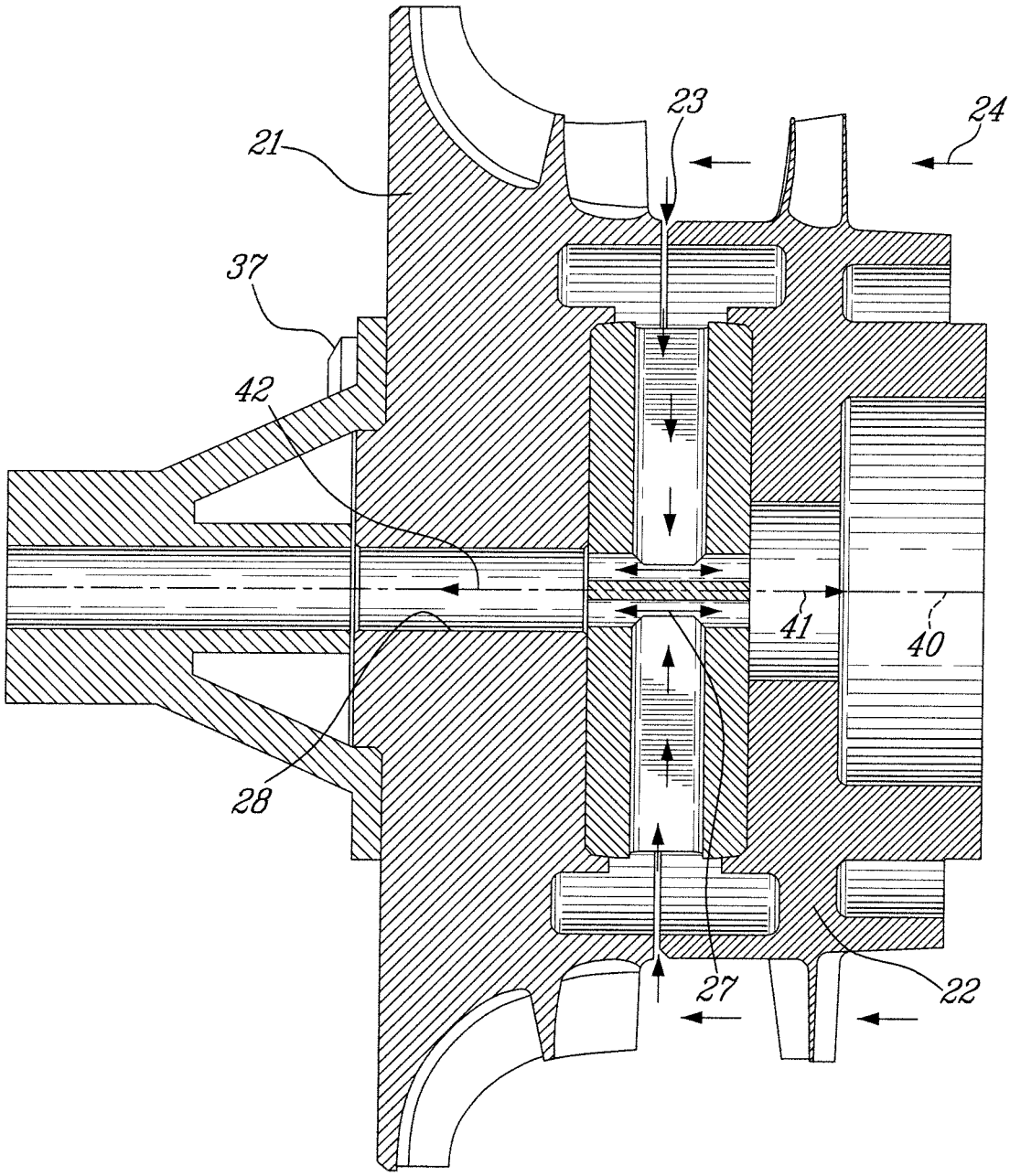
FIG. 2 is a cross-sectional view through the high pressure rotor assembly illustrating the anti-vortex device of FIG. 1, in this example clamped between an impeller rotor and a rotor disc of the rotor assembly.

Referring to the drawings and more particularly to FIG. 1, there is shown a gas turbine engine, herein a turbofan engine 10 of a type preferably provided for use in subsonic flight. The turbofan engine 10 generally comprises in serial flow communication a fan 11 through which ambient air is propelled, a multistage compressor 12 for pressurizing the air, a combustor 13 in which the compressed air is mixed with fuel and ignited for generating an annular stream of hot combustion gases, and a turbine section 14 for extracting energy from the combustion gases. The multi-stage compressor 12 is herein shown in simplified view but comprises among others a low pressure compressor rotor 15 followed by an assembly of high pressure rotors including a first axial compressor rotor 22 and an impeller 21 disposed downstream of the rotor 22 relative to the flow of air flowing through the gas path 24. As shown in FIGS. 1 and 2, an anti-vortex device 20 is clamped between the rotor 22 and the impeller 21 for bleeding off high pressure air from the compressor 12, as will be described hereinbelow. It is understood that the anti-vortex device could be used in other suitable types of gas turbine engines, such as auxiliary power units and turboprop engines. It is also understood that the device may be employed in a compressor bolted together with a tie-rod or held together in any other suitable arrangement.

Figure 3:
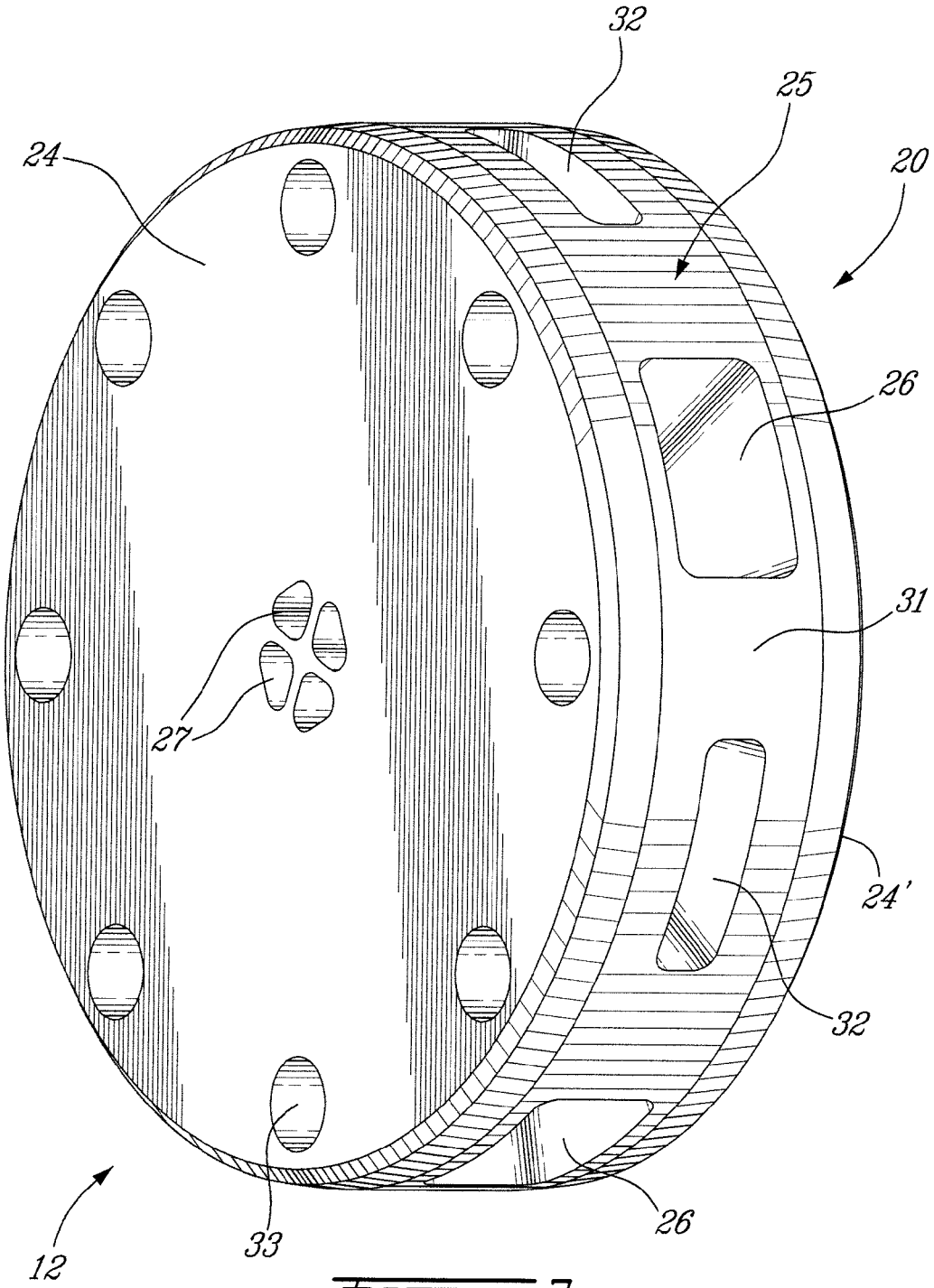
FIG. 3 is a perspective view illustrating the construction of the anti-vortex drum of FIG. 2 in accordance with one embodiment.
Figure 4:
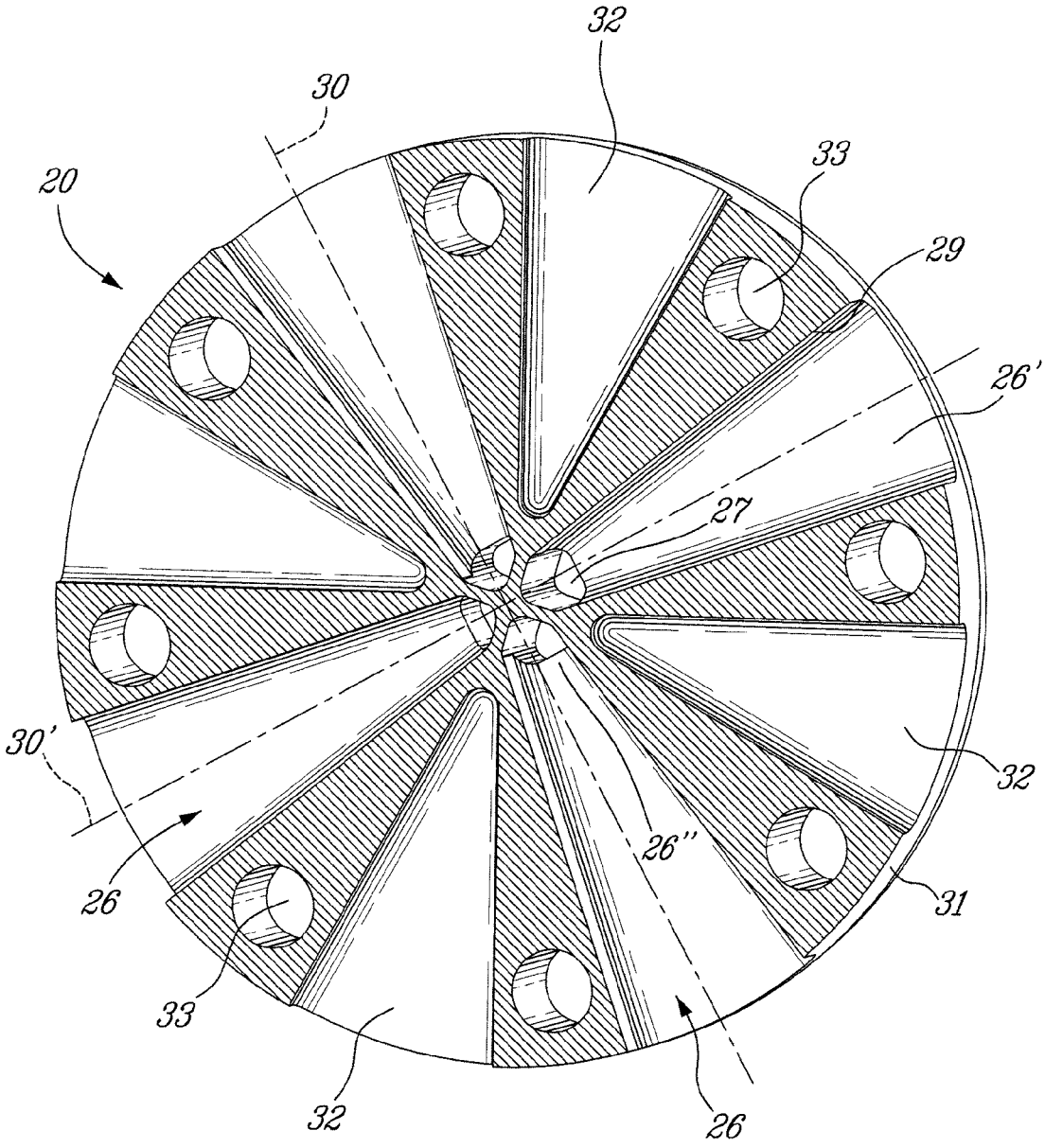
FIG. 4 is a section view through the anti-vortex device of FIG. 2 showing an example configuration of the radial passageways and the axially extending passage, showing axially extending passages associated respectively with each of the radial passageways and disposed for communication with a central axial passage of the compressor of the gas turbine engine.

With reference now to FIGS. 2 to 4, there will be described the construction and operation of one example of the anti-vortex device 20. As therein shown, the anti-vortex device 20 is clamped between two high pressure rotor parts, herein the impeller 21 and axial compressor rotor 22 and it is dimensioned whereby it is spaced radially inwardly of an air bleed gap 23 formed between the impeller 21 and rotor 22. The air bleed gap 23 extends radially from the anti-vortex device to the periphery of the high pressure rotor assembly formed by the impeller 21 and the rotor 22 and is in fluid flow communication with the gas path 24. The anti-vortex device 20 is thus spaced radially inwardly from the inner boundary of the gas path 24. Accordingly, the anti-vortex device 20 does not interfere with the air flowing on the peripheral surface of the high pressure rotor assembly of the compressor 12.

As shown in FIGS. 2 and 3, the anti-vortex device 12 is a circular disc- or drum-shape and has opposed circular side walls 24 and 24' which are spaced apart by a solid body portion 25. Spaced-apart radial passageways 26 are formed in the solid body portion 25. These radial passageways 26 each extend from an axially extending passage 27, herein four axial passages 27 being provided, each of which is in communication with a respective one of four radial passageways 26. The axially extending passages 27 are disposed between and through the opposed circular side walls 24 and 24', in a central area thereof, whereby to be in communication with a central axial passage of the rotor assembly which communicates with a central axial passage in the turbine 14.

As better shown in FIG. 4, each of the radial passageways 26 extend along an associated radius portion 29 of intersecting diametrical axes 30 and 30' of the device 20. The radial passageways 26 are cone-shaped passageways tapering inwardly from an inlet end 26' at the outer peripheral rim surface 31 to an outlet end 26" which communicates with a respective one of the axial passages 27.

The anti-vortex device 20 is formed from a solid mass, herein titanium, and the radial passageways 26 and axial passages 27 are machined from this mass. Also machined are cone-shaped cavities 32 disposed between the radial passageways 26 and of like transverse configuration but with the exception that the cavities 32 do not communicate with an axial passage. These cavities are formed to reduce the weight of the device 20. Tie-rod holes 33 are provided in the solid mass between the radial passageways 26 and the cone-shaped cavities 32 to receive corresponding tie rods 37 (FIG. 2) in order to secure the anti-vortex device 20 in position between the clamped rotors. The tie-rods 37 provide axial clamping to keep the rotor stack clamped together at all running conditions. The tight fit spigot diameters on both sides provide the concentric alignment between rotors of the rotor assembly. Refining machining is effected to balance the device 20. The anti-vortex device 20 therefore offers a single part of reduced weight which can be accurately positioned between rotors in a multi-stage compressor and simultaneously provide consistent rotor balancing. It also contributes to the structural integrity of the compressor while recovering angular momentum from the flow of compressed air. Also, the air bled from the surface of the rotor assembly is channeled in by the radial passageways 26 and distributed axially in both directions at the central axis 40 of the compressor where it communicates with the central passage 28 of the high pressure engine shaft due to the provision of the axial passages 27 in communication with each of the radial passageways 26. As previously described, because the air is drawn through the air bleed gap 23, there are no parts that interfere with the main gas path 24 of the compressor as air is drawn from the boundary layer of the compressor 12.

From a geometrical point of view, the anti-vortex device 20 channels some of the compressed air towards a small outlet area along the engine axis and in a compressor rotating at high r.p.m. Since most of the pressure drop occurs in the low radius region near the engine axis 40, the structural shape and disposition of the radial passageways 26 provides for reduced pressure drops. As herein shown, these radial passageways 26 are disposed along radius portions of transversely intersecting diametrical axes 30 and thus form an "X" structural shape (generally speaking, though it is understood that the "X" may have more or less than 4 legs, and as such the shape may be more akin to a star or wheel spokes than an "X" per se; thus it is understood that the shape is not strictly speaking limited to an arrangement which has the shape of the letter X) which helps to distribute the flow of compressed air as it facilitates the change of direction of the bled compressed air from radial to axial direction without allowing the air to mix. That is to say, each radial passage 26 has an associated axial passage 27 to redirect its flow, to reduce the swirl level of the bled air at that location to that of the rotating speed of the disc. Otherwise, there would be a higher pressure drop than is present with the anti-vortex device. The independent passageways and their transverse passages orient the channeling of the bled air and keep the stress at an acceptable level. These designs also satisfy the requirements of aerodynamics, stress and manufacturing requirements in a gas turbine engine. Although the anti-vortex device 20 is herein shown being secured in the rotor assembly of a turbofan gas turbine engine, it is not restricted to such engines and may be incorporated in an auxiliary prime unit, a turboshaft engine, a turboprop engine or other turbine power plant where there is a need to bleed air from the high pressure gas path for cooling a turbine section of the power plant.

Briefly describing the method of operation of the example of the anti-vortex device described above, the device 20, when in operation, rotates at high speeds, reduces total pressure drop and prevents the formation of free vortex of compressed air flowing from a compressed air path of a high pressure rotor towards an axial central passage of the rotor assembly and the engine. The method comprises securing the anti-vortex device 20 between opposed rotor elements of a compressor rotor assembly, whereby high pressure air from the primary gas path 24 of the compressor is bled through the air bleed gap 23 between the rotor elements and enters the anti-vortex device 20 at the outer peripheral rim surface 31 thereof and led towards the center of the compressor through the radial passageways 26 and transverse passages 27. The airflow in the radial passages 26 is split axially by the transverse passages 27 associated with each of the radial passageways 26, in two opposite directions; to further minimize the pressure drop. A first portion of the re-directed air flow can be utilized to pressurize a buffer seal, not shown, with this redirected air flow herein indicated by arrow 41 (FIG. 2) and in the opposite direction, as indicated by arrow 42 to provide cooling air for the turbines at the other end of the engine. The reduced pressure drop results in increased source pressure and permits driving cooler air to the turbines. The cooler air results in reduced turbine disc temperatures and reduced specific fuel consumption (SFC). The anti-vortex device 20 achieves its intended purpose from a single part machined entirely from one solid block of material. In addition, the anti-vortex drum 20 may be held in place, as in the above example, by simply trapping it and clamping it between two adjacent rotor parts as found in legacy engines with clamped compressor drums. Any other suitable attachment method may be used, as well. As can be appreciated from FIG. 4, the "X"-shaped structural web between the central axially extending passages 27 permits to reduce the swirl level at that location to that of the rotating speed of the disc. Otherwise, there would be a higher pressure drop there. The X-shaped structural webs also allow sustaining high stresses in the region of the central holes. This "X" structural shape, with independent axial passageways, helps to distribute the flow of compressed air by facilitating the change of direction of this flow from radial to axial directions.

The above description is meant to be exemplary only, and one skilled in the art will recognize that changes may be made to the embodiments described without departing from the scope of the invention disclosed. For example, although the anti-vortex device has a "disc" or "drum" geometry in the above example, any suitable configuration may be employed which achieves the taught result. For example, the device need not be one-piece as described, but may have multiple pieces. The device need not be machined from solid as described, but may be provided in any suitable manner. Also, in will be understood in light of the above description that the anti-vortex device need not be provided as a separate component as described above, but rather it may be integrated where suitable into another component, such as a rotor disc, impeller, stub-shaft, etc. Still other modifications which fall within the scope of the present invention will be apparent to those skilled in the art, in light of a review of this disclosure, and such modifications are intended to fall within the appended claims.

What is claimed is:

1. A compressor rotor assembly mounted for rotation about a central axis of a gas turbine engine, comprising an anti-vortex device having a body mounted between adjacent rotor discs, the rotor discs having a peripheral rim surface defining an inner boundary of a primary gas path of the engine, the anti-vortex device defining circumferentially spaced-apart radial passageways extending from respective axially extending central passages to an outer peripheral rim surface of the device, the axially extending central passages being defined in a central solid area of the body of the device, the axially extending central passages being independent from each other and communicating with an associated one of said radial passageways, each said radial passageway receiving bleed air from the primary gas path and directing it to an associated one of said axially extending passages, wherein the axially extending central passages extend axially forwardly and rearwardly from the radial passageways.

2. The compressor rotor assembly as claimed in claim 1, wherein the anti-vortex device comprises a solid body, and wherein said radial passageways extend through said solid body in an X-shaped configuration.

3. The compressor rotor assembly as claimed in claim 2, wherein said axially extending central passages being constituted by through bores disposed about a center point of said solid body and spaced to communicate at opposed ends thereof with a central axial passage of the compressor rotor assembly.

4. The compressor rotor assembly as claimed in claim 2, wherein said radial passageways are cone-shaped passageways tapering inwardly from an inlet end thereof at said outer periphery to an outlet end.

5. The compressor rotor assembly as claimed in claim 1, wherein said anti-vortex device has a drum body formed from a solid mass with said radial passageways and axially extending passages being machined from said solid mass, and cavities formed in said drum body between said circumferentially spaced-apart radial passageways.

6. The compressor rotor assembly as claimed in claim 1, wherein the anti-vortex device is spaced radially inwardly of an air bleed gap between said adjacent rotor discs.

7. The compressor rotor assembly as claimed in claim 2, wherein said solid body defining an X-shaped structural web between said axially extending central passages.

8. The compressor rotor assembly as claimed in claim 5, wherein said drum body is further provided with a transverse rod receiving through hole disposed between the radial passageways.

9. The compressor rotor assembly as claimed in claim 6, wherein the rotor discs respectively form part of an impeller and an adjacent compressor rotor, and wherein the anti-vortex device is clamped between opposed faces of the compressor rotor and the impeller.

10. A gas turbine engine comprising a compressor having at least two rotors mounted for joint rotation about a central axis, a combustor and a turbine section; the compressor has an anti-vortex device secured between said at least two rotors, the anti-vortex device having a solid body portion, circumferentially spaced-apart radial passageways defined in said solid body portion, each said radial passageway extending from an axial passage extending through the solid body portion in a central area thereof to an outer peripheral rim surface of the solid body portion, the solid body portion defining a solid structural web centrally between the axial passages, the outer peripheral rim surface being spaced inwardly of an air bleed gap formed between said at least two rotors and in communication with a gas path of the engine, the anti-vortex device being configured for channeling air from the gas path in non-interference therewith through said air bleed gap and into said radial passageways and said axial passages, said axial passages extending axially forwardly and rearwardly relative to said associated radial passageways for redirecting said air under pressure in two opposite axial directions.

11. The gas turbine engine as claimed in claim 10, wherein said axial passage is in communication with a central axial passage of the gas turbine engine extending into said turbine section, the air under pressure drawn into the axial passage being directed into the central axial passage to provide cooling air for the turbine section.

12. The gas turbine engine as claimed in claim 11, wherein said radial passageways are disposed along two diametrical axes intersecting each other in an X-shaped configuration.

13. The gas turbine engine as claimed in claim 12, wherein said axial passage comprises individual through bores disposed about a center point of said solid body portion, each of said through bores communicating with said central axial passage of the gas turbine engine and with an associated one of said radial passageways.

14. The gas turbine engine as claimed in claim 13, wherein said radial passageways are cone-shaped passageways tapering inwardly from an inlet end thereof at said outer periphery to said outlet end communicating with said axial passage.

15. A method of reducing total pressure drop and the formation of free vortex in a flow of compressed air bled inwardly from a compressor of a gas turbine engine, the method comprising:

i) providing circumferentially spaced-apart radial passageways in an anti-vortex drum mounted to the compressor, the radial passageways extending from a plurality of axial passages extending through the anti-vortex drum in a central solid area of the anti-vortex drum to an outer peripheral rim of the anti-vortex drum;

ii) bleeding compressed air from a gas path of the compressor through said radial passageways and re-directing said compressed air coming from the radial passageways in two axially opposite directions in said axial passages when said compressor hub is rotating; and iii) directing at least some of the compressed air bled from said axial passages of the anti-vortex drum, via a central axially-extending passage of the compressor, to a turbine section of said gas turbine engine to cool turbine components in said turbine section.

16. The method as claimed in claim 15, wherein said split compressed air flows in opposite directions, said split compressed air flowing in a direction opposite to said air directed to said turbine section being directed to pressurize a buffer seal.

17. The method as claimed in claim 15, wherein step (i) comprises clamping an anti-vortex drum in concentric alignment between two adjacent rotors and spaced inwardly of a peripheral gap formed at an outer periphery of the rotors.

* * * * *